US007458677B2

(12) United States Patent
Morris et al.

(10) Patent No.: US 7,458,677 B2
(45) Date of Patent: Dec. 2, 2008

(54) REDUCTION OF TURBULENCE WITHIN PRINTING REGION OF INKJET PRINTER HEADS

(75) Inventors: Brian G. Morris, Dayton, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 114 days.

(21) Appl. No.: 11/425,265

(22) Filed: Jun. 20, 2006

(65) Prior Publication Data

US 2007/0291097 A1 Dec. 20, 2007

(51) Int. Cl.
*B41J 29/13* (2006.01)

(52) U.S. Cl. ..... 347/108

(58) Field of Classification Search ..... 347/108
See application file for complete search history.

(56) References Cited

U.S. PATENT DOCUMENTS 3,708,798 A * 1/1973 Hildenbrand et al. ..... 347/86
5,528,271 A * 6/1996 Ebisawa ..... 347/34
6,238,044 B1 5/2001 Silverbrook et al.
6,281,912 B1 8/2001 Silverbrook
6,290,349 B1 9/2001 Silverbrook et al.
2001/0028992 A1* 10/2001 Mallsion et al. ..... 430/309
2002/0191066 A1 12/2002 Bouchard et al.
2004/0004653 A1 1/2004 Pryor et al.
2005/0134658 A1* 6/2005 Rousseau et al. ..... 347/85
2005/0157118 A1 7/2005 Silverbrook
2005/0190238 A1 9/2005 Hibi
2005/0248646 A1 11/2005 Morris et al.

FOREIGN PATENT DOCUMENTS

JP 2006-15761 1/2006

* cited by examiner

*Primary Examiner*—Stephen D Meier
*Assistant Examiner*—Geoffrey Mruk
(74) *Attorney, Agent, or Firm*—William R. Zimmerli

(57) ABSTRACT

The turbulence of the air moved through an inkjet print head enclosure is reduced before reaching the printing region between the print head and a print medium by positioning a HEPA filtration system between an air inlet opening in the enclosure and the print head. Turbulence is removed from air moved through the air path by HEPA filtration of the air being drawn into the print head enclosure before reaching the printing region.

6 Claims, 7 Drawing Sheets

REDUCTION OF TURBULENCE WITHIN PRINTING REGION OF INKJET PRINTER HEADS

FIELD OF THE INVENTION

The present invention relates to the field of ink jet printers. More specifically, the invention relates to methods of providing laminar air within a printing region of such printers so that printed artifacts are reduced.

BACKGROUND OF THE INVENTION

Ink jet printing systems are susceptible to turbulent air streams and paper dust, contamination that affect the proper functioning of the print head. Several methods of protecting the regions surrounding the print head from contamination have been established, such as by enclosing the print head and filling the enclosure with filtered air under positive pressure.

FIG. 1 is an example of such a prior art system, wherein a print head assembly is provided with a print head interface controller enclosure 1 having an air inlet fan 2 adapted to force air into enclosure 1 through a replaceable air inlet filter 3. The filter reduces the amount of foreign debris from the internal components of the print head. The air stream through the print head assembly continues from air inlet fan 2, around a manifold 4, into a manifold filter 5, and into a print head 6. The direction of print media travel past the print head is illustrated in FIG. 1 by a dotted line arrow 7, while air stream direction is depicted by a set of arrows 8.

While these structures have greatly reduced particle-based malfunctions, the prior art has not addressed the issue of non-straight ink droplet trajectories caused by turbulent air streams between print head nozzle openings and the print media (herein referred to as the "printing region"). The straightness of the ink droplet trajectories is vital to the proper placement of droplets onto a print medium. When turbulent air streams occur within the printing region, the affected jet causes misregistration of droplets and less than desired print quality.

Air turbulence in the printing region has at least two sources. Air turbulence is generated by air inlet fan 2 itself as it generates the air stream. Turbulence is also generated when high velocity air turns around objects and interfaces. These objects and interfaces may be corners and edges of the print head structure or may even be dirt particles and debris that has settled on interior surfaces of enclosure 1. The objects and interfaces can trip the air boundary layer and decrease laminar airflow, thus increasing the variation in the speed and/or direction of the air stream. These air stream variations can be sufficient to change the speed and direction of ink droplets ejected from the print head.

The air streams are necessary for cooling and contamination reduction, but the turbulence within the air stream needs to be controlled to inhibit print artifacts. Accordingly, it is an object of the present invention to reduce the turbulence of an air stream in a print head.

SUMMARY OF THE INVENTION

In accordance with a feature of the present invention, it has been found that the turbulence of the air moved through an inkjet print head enclosure can be reduced before reaching the printing region by positioning a HEPA filtration system between an air inlet opening in the enclosure and the printing region.

According to another feature of the present invention, a method is provided for reducing artifacts in images produced by an inkjet print head. The method includes moving turbulent air through an air path from an air source toward the printing region and positioning a HEPA filtration system in the air path such that only laminar air flow is introduced to the printing region.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
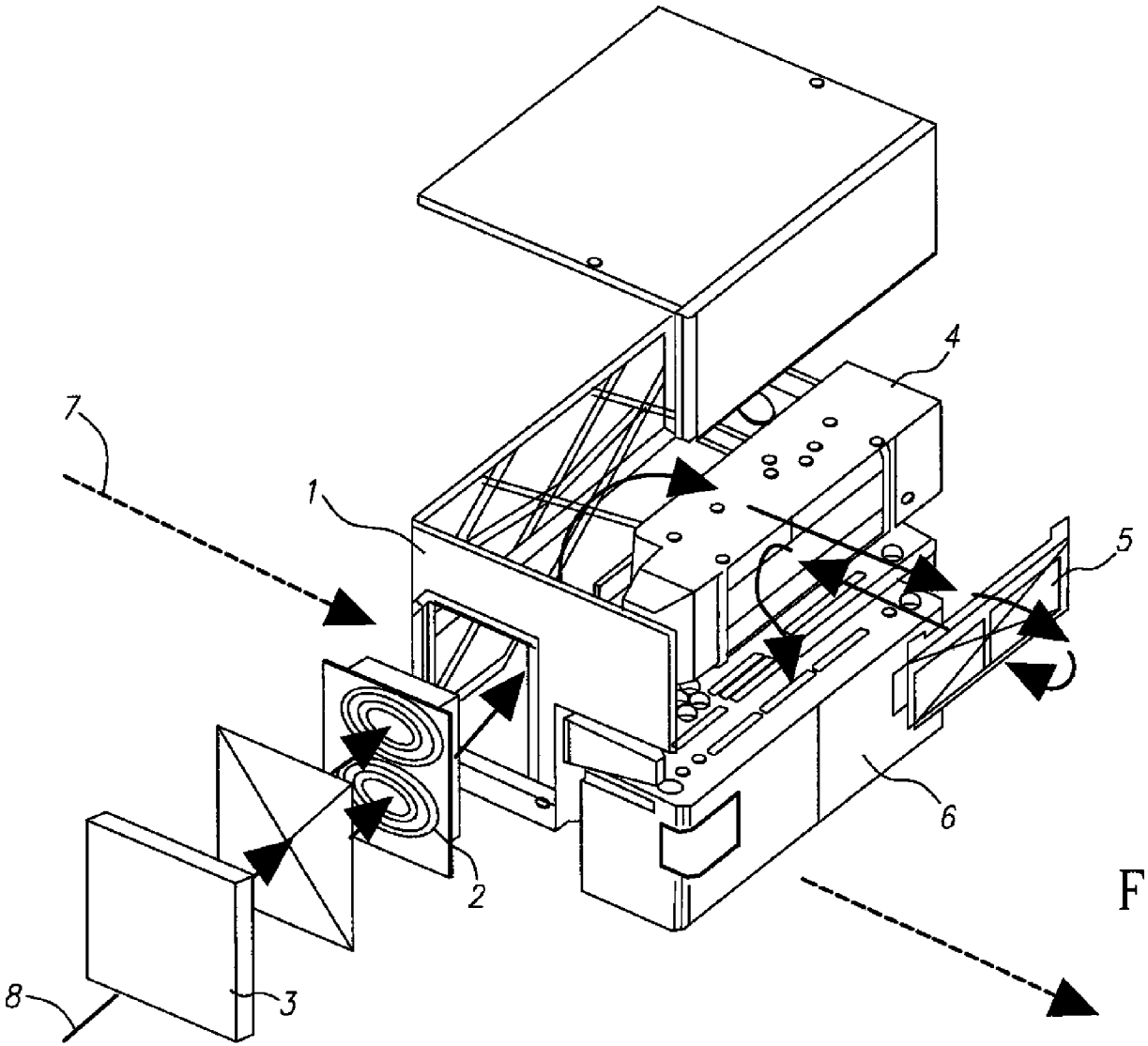
FIG. 1 depicts a prior art print head interface controller with filtration system.
Figure 2:
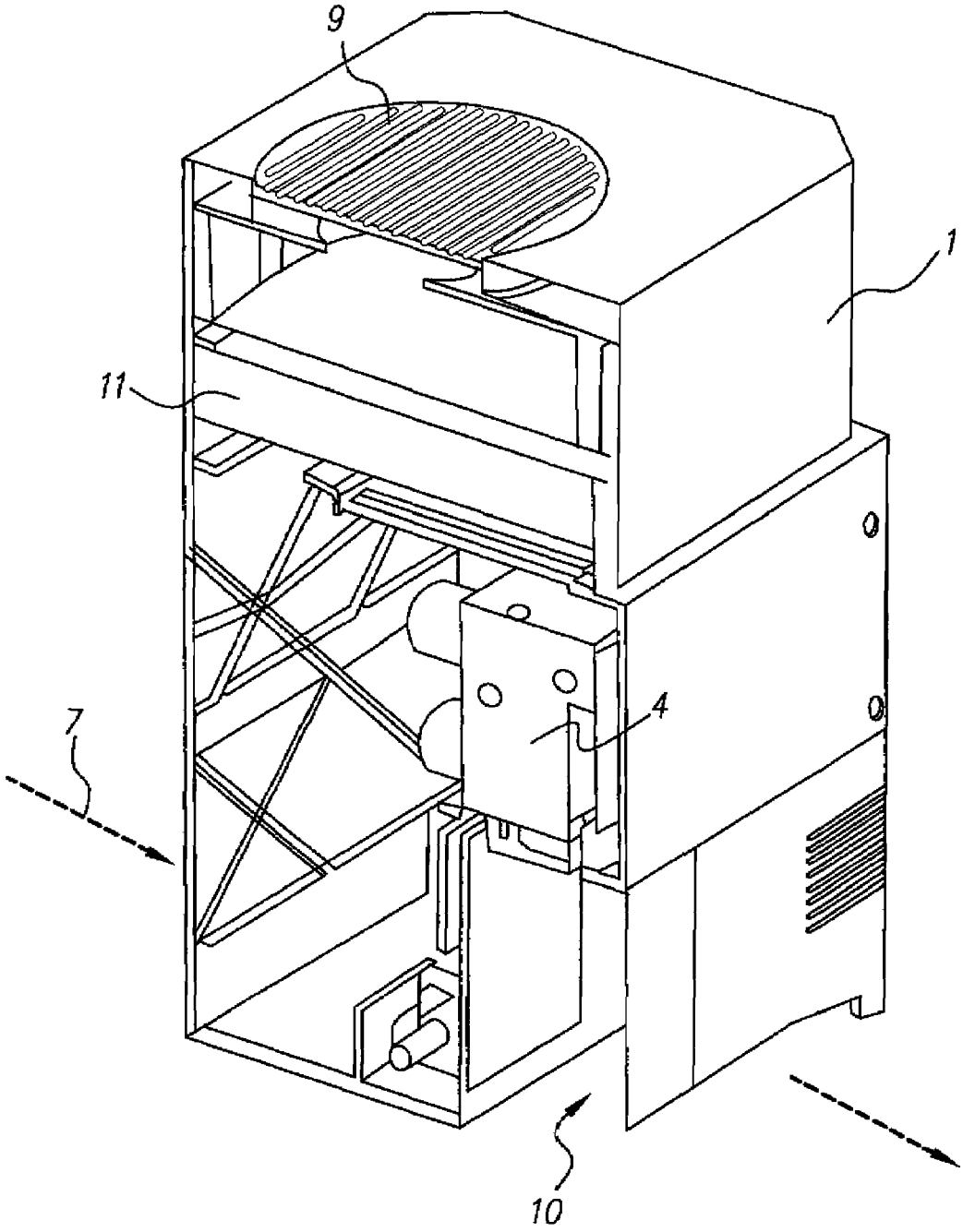
FIG. 2 depicts a print head interface controller according to the present invention.

FIG. 2 illustrates a print head assembly according to a preferred embodiment of the present invention. Reference numerals that appear both in prior art FIG. 1 and in FIG. 2 refer to structure that is similar in function, but not necessarily identical in structure. For example, reference numeral 1 identifies a print head interface controller enclosure 1 in FIG. 2 that has the same function as print head interface controller configuration 1 of FIG. 1, but clearly differs in configuration. The same is true of manifold 4, which precedes the region 10 for placement of the print head (the print head has not been illustrated in FIG. 2 for clarity). As in the prior art, the manifold 4 may include a replaceable filter.

The print head assembly of FIG. 2 is positioned similarly to the print head assembly shown in FIG. 1, as designated by the print media movement direction 7. An air inlet opening 9 includes an air inlet fan and an air inlet filter (not individually shown), which draws air into print head interface controller enclosure 1 from the print head docking station. The air inlet filter associated with air inlet opening 9 may be replaceable.

A high efficiency particulate air (HEPA) filtration system 11 is positioned between air inlet opening 9 and manifold 4. Generally, HEPA filtration was developed by the Atomic Energy Commission during the Second World War to remove radioactive dust particles from the air in manufacturing plants. HEPA filters are conventionally made from very tiny glass fibers that are made into a tightly woven paper, but other constructions of HEPA filters are contemplated within the scope of the present invention. This creates a filter consisting of a multitude of very small sieves that can capture extremely small particles, including some biological agents. Once trapped, contaminates and particles are not able to stream back into circulation, due to the highly absorbent pores of the HEPA filter. HEPA filters are commonly used in hospital operating rooms, burn centers, laboratories and manufacturing facilities for products like computer chips, where particle and bacteria free air is mandatory. Beyond particulate filtration, HEPA filters are also capable of reducing air turbulence. That is, as air passes through the HEPA filter, a more laminar air flow results.

Figure 3:
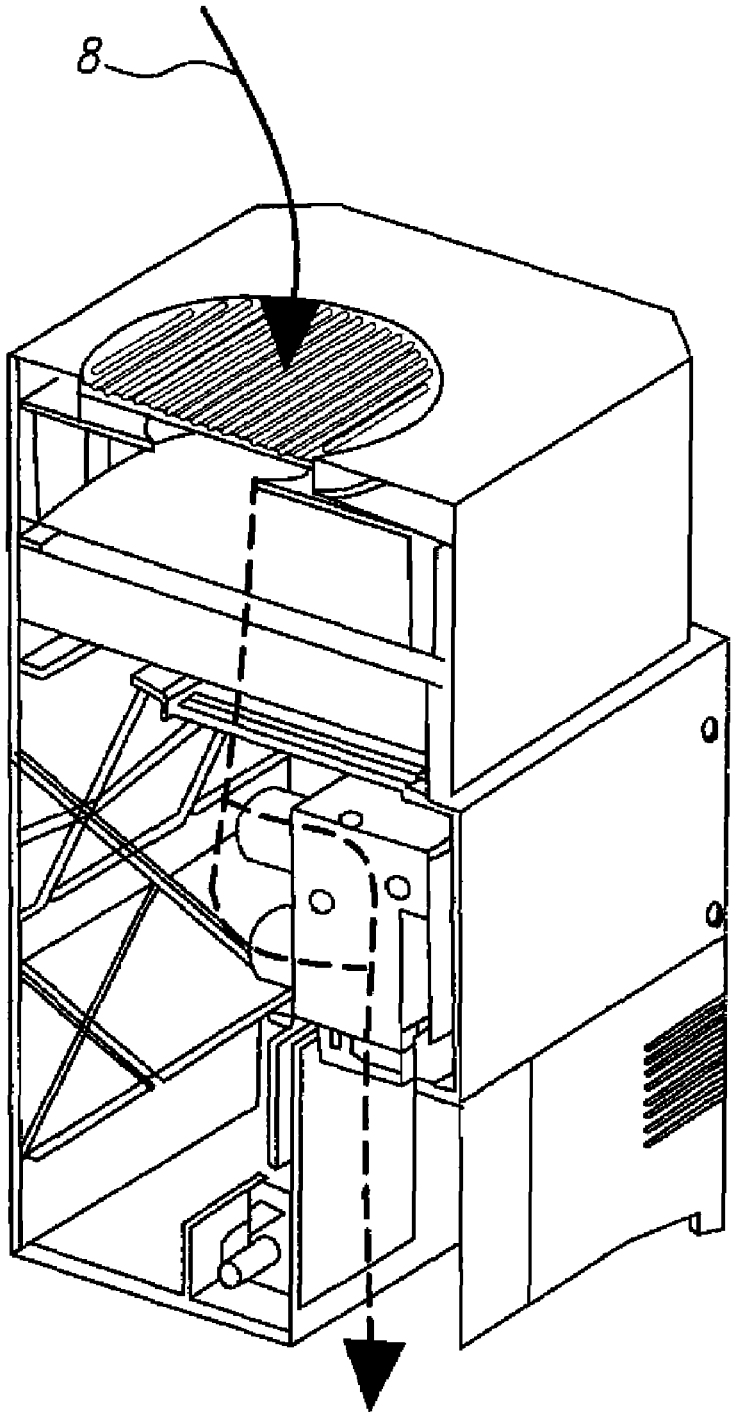
FIG. 3 is a view similar to FIG. 2 showing the direction of air stream through the print head.

As shown in FIG. 3, the stream direction 8 of the air within the illustrated embodiment begins at air inlet opening 9, where air is introduced into print head interface controller enclosure 1 by a fan (not shown). The air moves through a HEPA filtration system 11. The moving air may then stream into manifold 4, into the print head (not shown), and through an exhaust opening (not shown). The air stream helps cool the print head, and air pressure is maintained positive relative to ambient to prevent dirt particles from entering the enclosure.

Figure 4A:
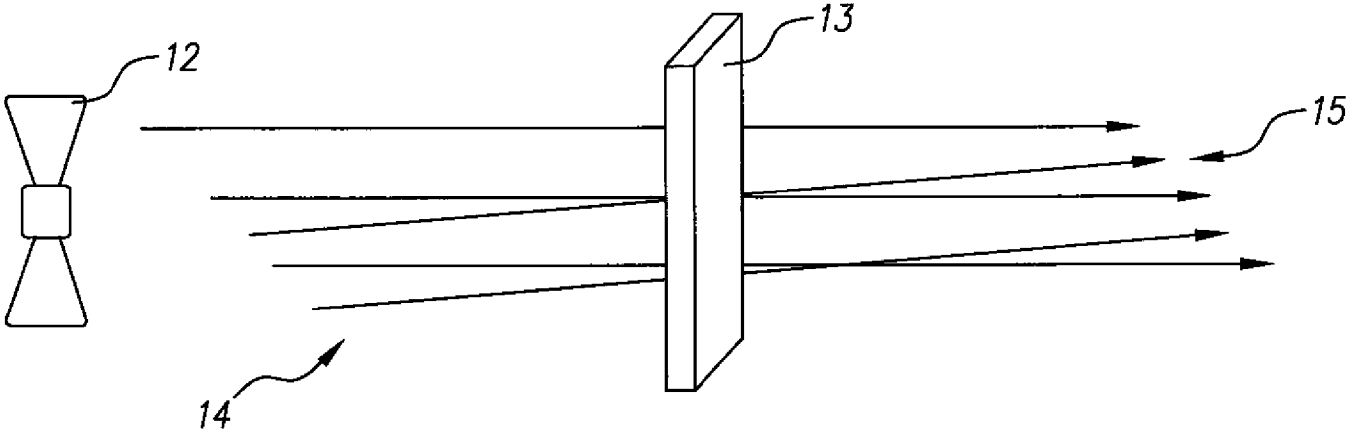
FIGS. 4A and 4B are schematic views of the difference in air stream through a non-HEPA filtration system and a HEPA filtration system, respectively.
Figure 4B:
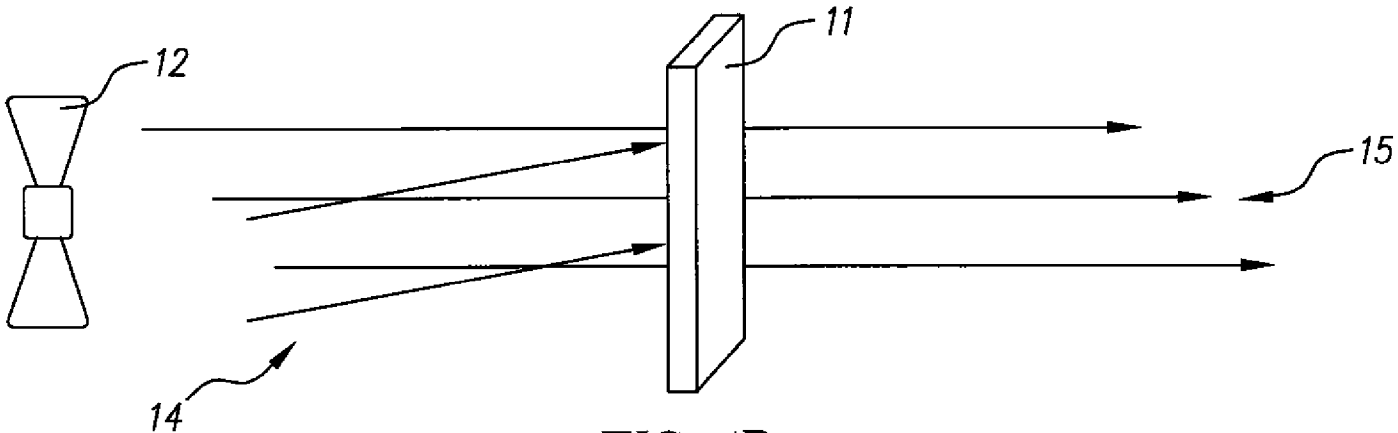

The air inlet fan necessarily introduces air turbulence into the air stream through inlet opening 9. FIGS. 4A and 4B compare the amount of air turbulence 14 from an air fan 12 that is able to pass a non-HEPA filtration system 13 and a HEPA filtration system 11, respectively. As can be seen from the schematic drawing, the presence of a non-HEPA filtration system 13 does little if anything to decrease turbulence 14, as shown in FIG. 4A. By contrast, in FIG. 4B, HEPA filtration system 11 reduces the turbulence and creates laminar output air stream 15.

The straightness requirement for the travel path of an ink droplet is dictated by the nominal resolution of the printer and is a function of the distance that ink droplets must travel between the nozzle and the print media. The space between the nozzle and the print media is referred to as the printing region. Target variation from a straight path in the printing region is preferably less than 3 milli-radians. As desired resolutions increase, the straightness requirement for the travel path of an ink droplet becomes more critical (even to less than 2 milli-radians) and more sensitive to air turbulence. Air turbulence in the printing region causes unpredictable print misregistration.

The air pressure within print head interface controller enclosure 1 is controlled, and air turbulence in the printing region is minimized by HEPA filtration system 11. The HEPA filtration system placement according to the present invention provides a laminar stream with minimal turbulence into the printing region.

Figure 5A:
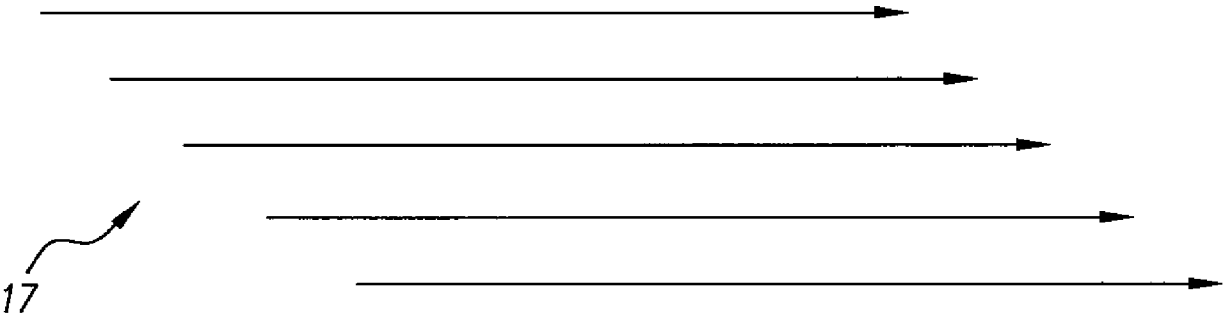
FIGS. 5A and 5B are schematic views of the difference in air stream without particles in the air stream and with particles in the air stream, respectively.
Figure 5B:
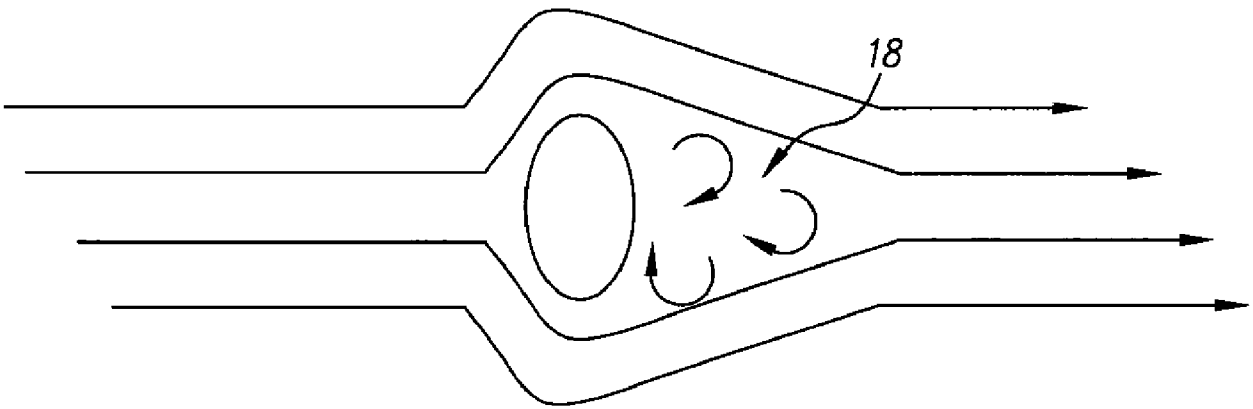

Turbulence that could affect ink jet straightness can also be generated when air, moving at high velocity, turns around objects and interfaces, such as particles and debris that settle on surfaces. FIGS. 5A and 5B demonstrate the difference between a laminar stream 17 and a foreign particle induced turbulent stream 18 when the air is disrupted by the presence of a foreign particle 16.

Figure 6A:
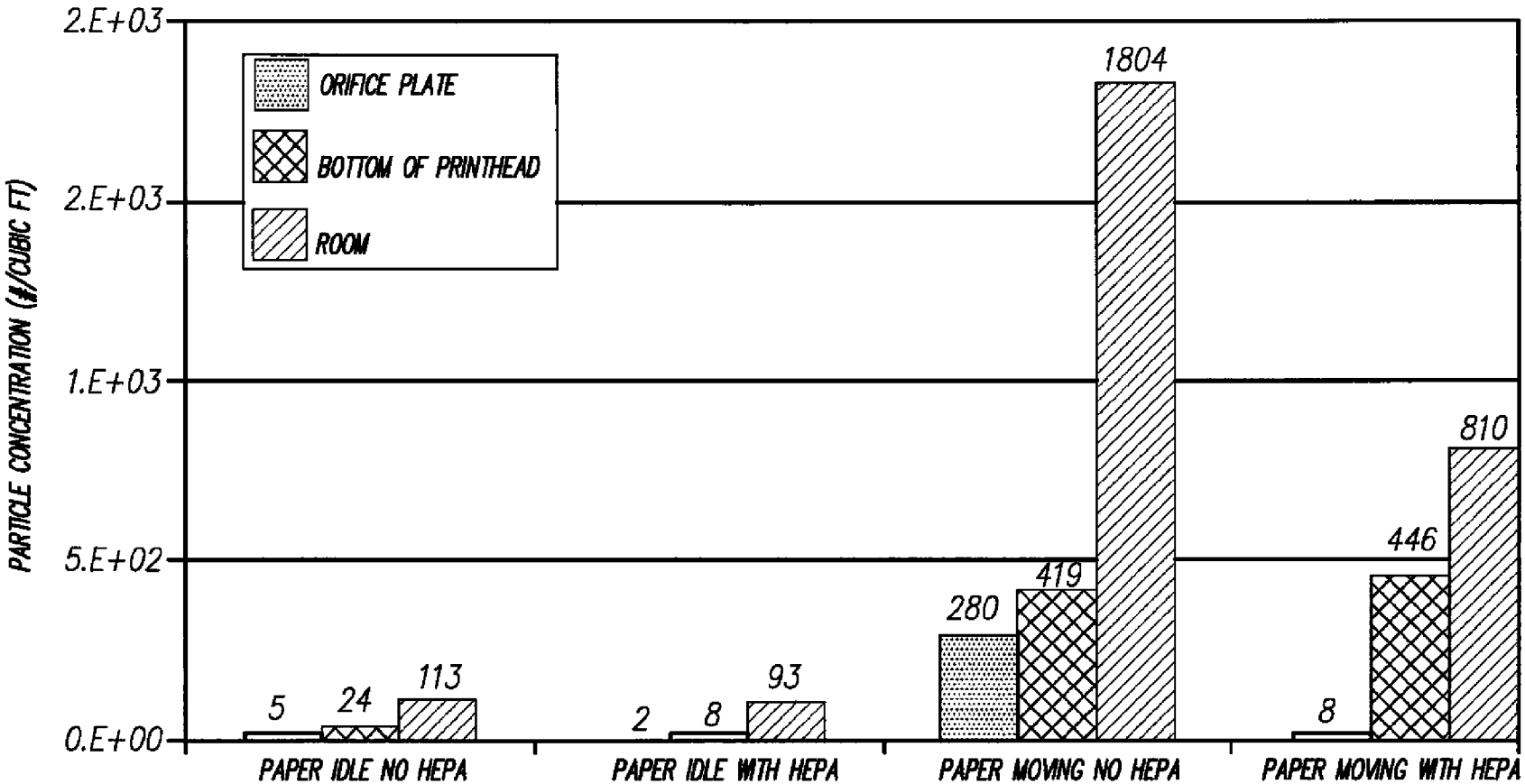
FIGS. 6A and 6B are graphs of concentrations of particles in a print head when media is at rest and moving, respectively.
Figure 6B:
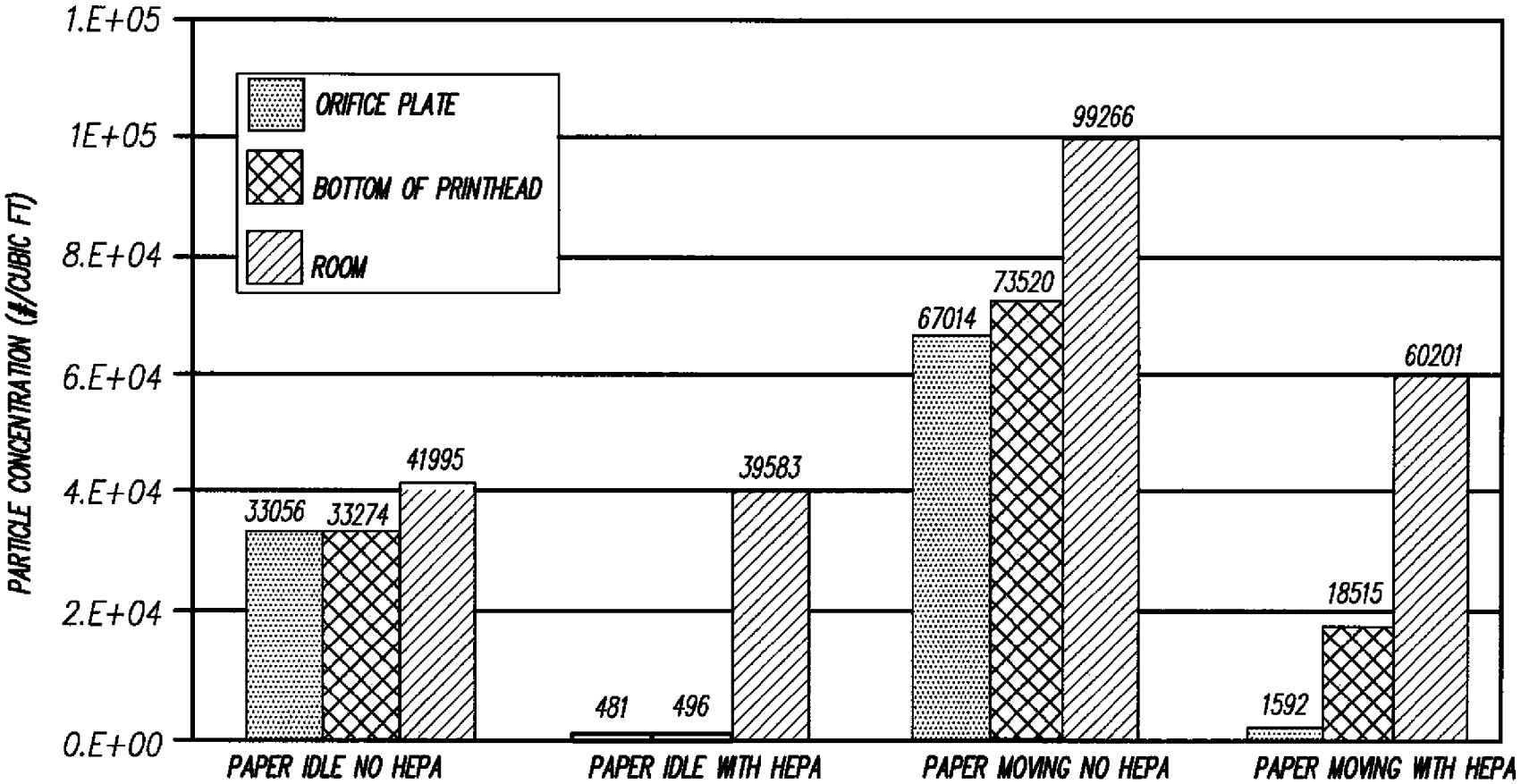

FIGS. 6A and 6B demonstrate the ability of the HEPA filtration system according to the preferred embodiment to remove foreign particles. Particle concentrations were measured during tests using an aerosol particle counter at the orifice plate, at the bottom of the print head, and in the room adjacent to the print head assembly. FIG. 6A a reduction of foreign particles greater than 5 μm in diameter when a HEPA filtration system is employed according to the present invention. Even in the situation where the print media is in motion through the printer, the HEPA filtration system has effectively reduced the particle counts at both the orifice plate and the bottom of the print head. FIG. 6B demonstrates similar data but for foreign particles of at least 0.5 μm in diameter. The reduction in foreign particle counts within the region of the orifice plate demonstrates the significance of the HEPA filtration system in effectively reducing this source of air turbulence.

The invention has been described in detail with particular reference to certain preferred embodiments thereof, but it will be understood that variations and modifications can be effected within the spirit and scope of the invention.

PARTS LIST

1) print head interface controller enclosure
2) Air inlet fan
3) Air inlet filter
4) Manifold
5) Manifold filter
6) Print head
7) Print media movement direction
8) Air stream direction
9) Air inlet opening
10) Placement of print head
11) HEPA filtration system
12) Air fan
13) Non-HEPA filtration system
14) Input air
15) Output air
16) Foreign particle
17) Laminar air
18) Foreign particle induced turbulent stream

The invention claimed is:

1. An inkjet print head system comprising:

an enclosure having an air inlet opening;

a fan adapted to move air into the enclosure through the air inlet opening;

a print head adapted to eject fluid droplets through a printing region between the print head and a print medium, wherein the printing region is exposed to air being moved in the enclosure by the fan;

a HEPA filtration system positioned between the fan and the printing region such that turbulence in the air moved through the air inlet opening is reduced by the HEPA filtration system before reaching the printing region;

a manifold through which air flows into the print head, said manifold being located within the enclosure; and a replaceable non-HEPA filter is associated with the manifold.

2. An inkjet print head system comprising:

an enclosure having an air inlet opening;

a fan adapted to move air into the enclosure through the air inlet opening;

a print head adapted to eject fluid droplets through a printing region between the print head and a print medium, wherein the printing region is exposed to air being moved in the enclosure by the fan;

a HEPA filtration system positioned between fan and the printing region such tat turbulence in the air moved through the air inlet opening is reduced by the HEPA filtration system before reaching the printing region;

a manifold through which air flows into the print head, said manifold being located within the enclosure, wherein the HEPA filtration system is positioned between the air inlet opening and the manifold.

3. The inkjet print head system of claim 2, wherein the enclosure is a print head interface controller enclosure.

4. The inkjet print head system of claim 2, wherein the HEPA filtration system is comprised of a HEPA replaceable filter.

5. The inkjet print head system of claim 2, wherein a replaceable non-HEPA filter is associated with the air inlet opening.

6. The inkjet print head system in claim 2, wherein the HEPA filtration system is adapted to remove particulate sources ofturbulence from the air entering the enclosure.

* * * * *